US005873988A

United States Patent [19]

Schulze et al.

[11] Patent Number: 5,873,988

[45] Date of Patent: Feb. 23, 1999

[54] MULTILAYER ELECTRODE FOR ELECTROLYSIS CELL

[76] Inventors: Dirk Schulze, Langenbachstr. 2, 53113 Bonn; Wolfgang Beyer, Bergstr. 35, 53359 Rheinbach, both of Germany

[21] Appl. No.: 856,237

[22] Filed: May 14, 1997

[30] Foreign Application Priority Data

May 14, 1996 [DE] Germany ..... 196 19 333.8

[51] Int. Cl.[6] ..... C25B 11/00

[52] U.S. Cl. ..... 204/290 F; 204/284; 204/290 R; 429/40; 429/41; 429/42; 429/44; 429/45

[58] Field of Search ..... 204/284, 290 F, 204/290 R; 429/40, 41, 42, 44, 45

[56] References Cited

U.S. PATENT DOCUMENTS 4,554,225 11/1985 Sounai et al. ..... 429/45
4,975,171 12/1990 Nishiki et al. ..... 204/254

OTHER PUBLICATIONS

Dechema Monographs, vol. 94, Verlag Chemie 1983, pp. 211–223.

*Primary Examiner*—Bruce F. Bell
*Attorney, Agent, or Firm*—Antonelli, Terry, Stout & Kraus, LLP

[57] ABSTRACT

The invention relates to a multilayer electrode with a porous core structure produced by sintering and composed of an electrically conducting material for an electrolysis cell, especially with a solid electrolyte, in which the porous core structure contains at least two layers of spherical bodies made of metal packed densely together, said layers being formed by sintering and connected together, with the layer facing the electrolyte forming the active layer and being made as a fine layer of spherical bodies of the same or approximately the same size and the layer that covers the active layer on the back being made as a coarse layer of spherical bodies that are larger than the spherical bodies in the active layer.

15 Claims, 2 Drawing Sheets

MULTILAYER ELECTRODE FOR ELECTROLYSIS CELL

TITLE OF THE INVENTION

The invention relates to a multilayer electrode with a porous core structure produced by sintering and consisting of an electrically-conducting material for an electrolysis cell, especially for an electrolysis cell provided with a solid electrolyte.

BACKGROUND OF THE INVENTION

Electrolysis cells equipped with solid electrolytes are used in particular for electrolytic processes such as water electrolysis for producing ozone, HCl and NaCl electrolysis. For example, perfluorinated ion exchange membranes are used as the solid electrolyte and the electrolytes are connected directly with the membrane as porous structures. The porosity of the electrodes is necessary to guarantee the supply of reactants and to remove reaction products from the solid-solid interface between the electrode and the electrolyte (see Dechema Monographs, Volume 94, Verlag Chemie 1983, pages 211 to 223 or U.S. Pat. No. 4,975,171).

Known electrodes with a porous structure are manufactured by compressing and sintering fibrous powder. The disadvantage of the known porous electrodes is the formation of capillaries in which bath residues can accumulate during the subsequent galvanic coating of the electrodes. The galvanic bath residues can be removed only with difficulty. In addition, the flushability of the known porous structures of the electrodes has not been satisfactory thus far because the sufficient flushing desired is not always provided due to the irregular structures formed by sintering.

SUMMARY OF THE INVENTION

The goal of the invention is to provide electrodes with a porous structure in which capillary formation is suppressed and which permit a good flushability of the electrodes, and in which the structure can be produced reproducibly.

This goal is achieved in multilayer electrodes with a porous core structure by virtue of the fact that the porous core structure contains at least two layers of densely packed spherical bodies made of metal, said layers being formed by sintering and connected to one another, with the layer facing the electrolyte forming the active layer and being in the form of a fine layer of spherical bodies of identical or approximately identical size, and with the layer covering the back of the active layer being in the form of a coarse layer of spherical bodies that are larger than the spherical bodies in the active layer.

According to the invention, nearly ideally geometric particles, namely spherical bodies, are used for the porous core structure which, by virtue of their configuration in the form of spheres packed together, contact one another only pointwise and form few capillaries. In addition, according to the invention only sintering is used to form the bond and not compression, nor even a combination of compression and sintering.

To form an advantageous electrode structure, it is provided according to the invention that the active or front side of the electrode is given a finer porous structure than the back which has a coarser porous structure.

In particular, the electrode according to the invention is characterized by a homogeneous structure of the active layer. By using and making a spherical globular structure for the porous core of the electrode using spherical bodies according to the invention, said bodies being made of a conducting metal, the flushability of the electrodes is considerably increased and bath residues are prevented from being retained in the porous structure during galvanization and application of surface layers to the electrode.

Advantageous embodiments of the electrode according to the invention with a porous core structure will be found in the characterizing features of the subclaims.

The structure of the porous core can be asymmetric with a fine layer as the active layer, made of spherical bodies, and a second layer as the coarse layer, made of spherical bodies with a diameter larger than that of the spherical bodies in the fine layer. However, it is also possible to make the porous coarse structure of the electrode symmetrical or nearly symmetrical, with a coarse layer as the inner layer and made of spherical bodies, and external fine layers made of spherical bodies that have a diameter smaller than that of the spherical bodies in the inner coarse layer.

Preferably the spherical bodies in the fine layer are, to the greatest degree possible, of the same size and shape or approximately the same size and shape in order to obtain a surface structure that is as dense and homogeneous as possible, especially on the active side of the electrode.

Likewise, spherical bodies of the same or approximately the same size and shape can be used for the coarse layer. However, it is also possible to select spherical bodies from a grain-size range for the coarse structure, in other words spherical bodies with smaller and larger diameters. During the manufacture of the porous multilayer core structure it is important to note that during the pouring of the spherical bodies of different sizes, an effect resembling sedimentation takes place, with the finest spherical bodies accumulating in direct contact with the active fine layer of spherical bodies and the coarser components of the coarse layer being located at a corresponding distance from the back of the active fine layer. Such an arrangement can be obtained by shaking while pouring onto the fine layer.

The method for making the multilayer electrode according to the invention and/or its porous core structure is characterized by the fact that the individual layers of the porous core structure are carefully poured in succession onto one another and the layers, once poured, are subjected to common sintering in a vacuum. It is also possible, first of all, to build up one of the layers, either a fine layer or the coarse layer, by pouring and then sintering and then pouring the next layer, either the coarse layer or the fine layer, on top of that and then sintering once again in order to achieve both the bond within the layer and the bond with the adjoining layer. In view of the fact that the electrode is made in three layers, the third layer is then added to the already-existing two layers.

Preferably bodies made of titanium are used as spherical bodies for the layers of the porous core structure. It is also possible to use spherical bodies made of bronze for a porous core structure that is intended to be used as a cathode.

The spherical bodies for the fine layer of the porous structure should have a diameter in the range from 100 to 250 $\mu$m, but they can also be smaller if appropriate spherical bodies are available. The spherical bodies for the coarse layer should have a diameter larger than the spherical bodies of the fine layer, preferably a diameter in the range from 200 to 800 $\mu$m, preferably in the range from 300 to 500 $\mu$m. If spherical bodies with a size range, i.e. a so-called grain size distribution, are used for the coarse layer, this grain size distribution should have a range from 100 to 1000 $\mu$m, preferably from 150 to 600 $\mu$m. Smaller or larger diameters of the spherical bodies are possible for both the fine layer and the coarse layer and depend upon the individual application.

The thickness of a porous core structure of an electrode according to the invention can be between approximately 1.0 and 1.7 mm, for example when used for ozone generation with the aid of a solid electrolyte.

The porous core structure of the electrode is coated on at least the fine layer that forms the active layer with a galvanically-applied carrier layer made of platinum metals. A β-lead dioxide layer is then applied galvanically to the carrier layer.

Depending on the design, the electrode can be connected at the back with a carrier.

The multilayer porous structure according to the invention, formed of spherical bodies by sintering, permits a very exact reproducibility of the layers and hence of the electrodes. Likewise a considerably improved flushability of the electrodes is obtained by comparison with conventional sintered and compressed electrodes.

The galvanic coating of the porous core structure of the electrode on the front and back using platinum metals serves to reduce stresses. For this purpose, a symmetrical structure of the electrode is especially desirable. The β-lead dioxide layer is also applied preferably on the front and back of the porous core structure on top of the carrier layer made of platinum metals in order to avoid stresses.

A porous core structure for the electrode is preferred, with a fine layer only on the active side and the coarse layer on the back in order to ensure a good flow of the reactants or reaction products in and out. With an asymmetrical design for the porous core structure as well, it is desirable to equip both the front and back with a carrier layer made of platinum metals and to apply a β-lead dioxide layer galvanically to this carrier layer.

BRIEF DESCRIPTION OF THE FIGURES

The invention will now be described in greater detail with reference to the drawing.

DETAILED DESCRIPTION OF THE INVENTION

Figure 1:
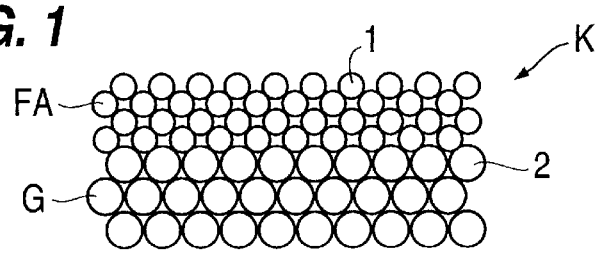
FIG. 1 is a schematic diagram of a porous core structure for an electrode with two layers.

The porous core structure K for an electrode according to FIG. 1 comprises two layers FA and G. Layer FA is a fine layer of spherical bodies 1 of the same size, and forms the active layer of the electrode. This active fine layer FA can be made very thin but is characterized by a high degree of reproducibility and homogeneity due to its being built up of identical spheres of the same size and shape. The active fine layer FA is therefore a defined layer.

Figure 6:
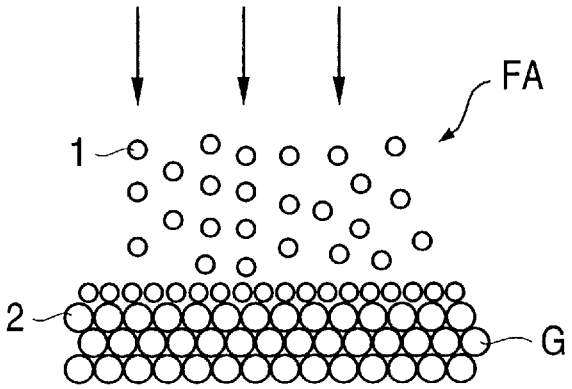
FIG. 6 is a schematic diagram of the production of the porous structure according to FIG. 1.

On the back of active fine layer FA, coarse layer G with a porous core structure is formed, made up of spherical bodies of a size and diameter greater than those of the spherical bodies in fine layer FA. The spherical bodies in coarse layer G are designated 2. Both layers FA and G are made by pouring the spheres in the manner of a spherical packing as shown in FIG. 6. In a first method step, one of the two layers, either coarse layer G or fine layer FA (in the example according to FIG. 6, coarse layer G is made first) is poured and consists of spherical bodies 2 of identical size, and then the spherical bodies 1 of fine layer FA are poured on top of layer G that has already been poured to form a spherical packing that is as dense as possible and has the desired thickness, after which the entire core structure is sintered to connect spherical bodies 1 and 2 to one another and to join layers FA and G.

Figure 2:
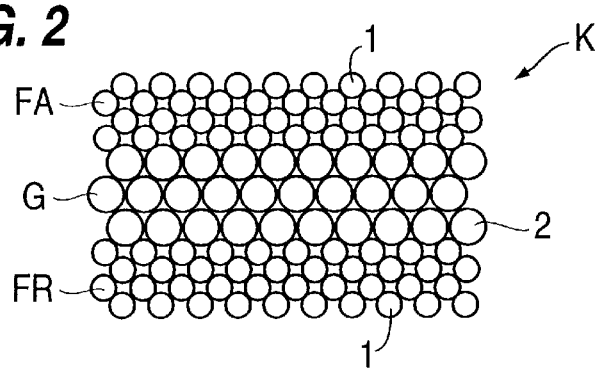
FIG. 2 is a schematic diagram of a porous core structure for an electrode with three layers.

FIG. 2 shows a symmetrically constructed porous core structure in which, as an improvement on porous core structure in FIG. 1, another fine layer FR is applied and sintered on the back of the coarse layer as a fine layer. The spherical bodies 1 of active fine layer FA and rear fine layer FR can be of the same size, or the spherical bodies in the fine layer on the back can be slightly larger than those in the active fine layer.

Figure 3:
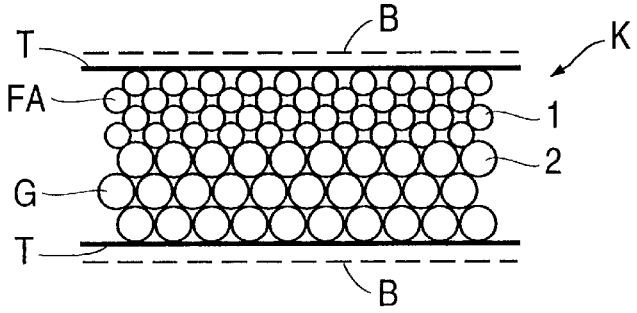
FIG. 3 shows a porous core structure for an electrode according to FIG. 1 with coatings on both sides.

FIG. 3 shows a multilayer electrode with a two-layer porous core structure according to FIG. 1 which is provided on the active side, namely the outside of fine layer FA and on the back of coarse layer G, with a carrier layer T applied galvanically and made of platinum metal. Spherical bodies made of titanium are used as spherical bodies 1 and 2 for the layers of the porous core structure. For fine layer FA, spherical bodies 1 have a size of about 180 $\mu$m for example. Spherical bodies 2 with a size of 500 $\mu$m are used for the coarse layer for example.

In the electrode according to FIG. 3, a layer of β-lead dioxide is applied galvanically on both sides of the electrode according to FIG. 3. This electrode structure according to FIG. 3 permits a good flushability especially through coarse layer G and also a very good contact on the active side through fine layer FA, and is characterized by uniform coating, high mechanical stability, and good electrical properties.

Figure 4:
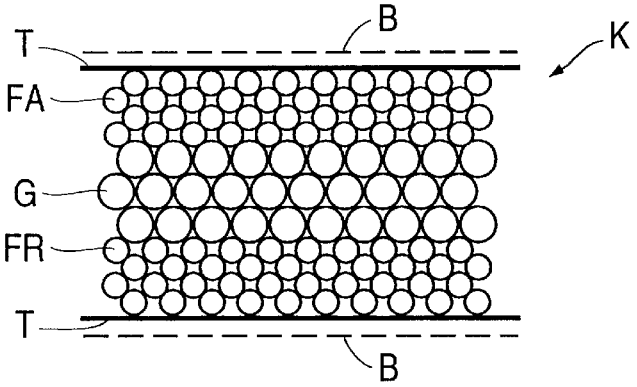
FIG. 4 shows a porous structure for an electrode according to FIG. 2 with coatings on two sides.

FIG. 4 shows a symmetrically structured electrode with a three-layer porous core structure according to FIG. 2 which is likewise plated with platinum on the front and back and is provided with a B-lead dioxide layer. Fine layers FA and FR can have very limited thicknesses by comparison with central coarse layer G, so that a good flushability and passageway for the reactants and/or reaction products is provided by an appropriately large coarse layer G.

Figure 5:
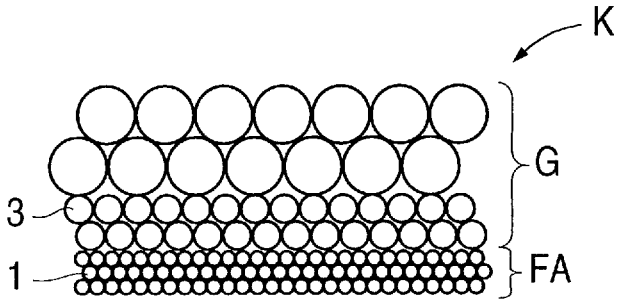
FIG. 5 shows a porous structure with two layers with grain size distribution.

FIG. 5 shows a porous core structure in which fine layer FA on the active side is made up of spherical bodies of the same size and is poured to form a dense layer. The coarse layer G made of spherical bodies with a grain size distribution from small to large is poured on top of it, for example by shaking and vibrating, on top of fine layer FA so that sedimentation produces a structure such that the finer spherical bodies 3 in coarse layer G collect directly in contact with fine layer FA and the coarser spherical bodies accumulate in a dense packing at a distance from fine layer FA. Then the entire core structure that has been poured in layers is sintered. This porous core structure K according to FIG. 5, as explained in FIGS. 3 and 4, can be provided on one and/or both sides but at least on the outside of fine layer FA with a carrier layer made of platinum metals, applied galvanically and then a β-lead dioxide layer can be applied on top of this galvanically.

We claim:

1. Multilayer electrode for an electrolysis cell, said multilayer electrode comprising a porous core structure produced by sintering, composed of an electrically conductive material, wherein said porous core structure contains at least two porous layers, of which one of said at least two porous layers facing the electrolyte forms an active layer and is formed as a fine layer and the other of said at least two porous layers which covers a back of the active layer is in the form of a coarse layer made of particles that are larger than the particles in the active layer, wherein the at least two porous layers contain spherical bodies made of metal being packed densely together and bonded by sintering together, and wherein said active layer is formed of spherical bodies of the same or approximately the same size, having an average diameter of 100 to 250 $\mu$m, and said wherein said coarse layer is formed of spherical bodies having a sphere size that is the same or approximately the same, and having an average diameter of 200 to 800 $\mu$m.

2. Electrode according to claim 1, characterized in that the back of the coarse layer of the porous core structure is covered by another layer on the back that is designed as a fine layer composed of spherical bodies made of metal of the same or approximately the same size, produced by sintering, with the spherical bodies forming the back layer being smaller than the spherical bodies in the coarse layer.

3. Electrode according to claim 2, characterized in that the fine layer that covers the back of the coarse layer is made of spherical bodies corresponding in size to the spherical bodies forming the active layer of the porous core structure.

4. Electrode according to claim 1, characterized in that spherical bodies are used for the coarse layer that have a size selected from a grain size range, with the spherical bodies in the poured layer being arranged in sizes that range from small to coarse and the fine components of the coarse layer are located directly adjacent to the active layer.

5. Electrode according to claim 4, characterized in that the spherical bodies with a grain size range that are used for the layer designed as the coarse layer of the porous core structure comprise a grain size range from 100 to 1000 $\mu$m.

6. Electrode according to claim 1, characterized in that spherical bodies made of titanium are used for the porous layers of the core structure.

7. Electrode according to claim 1, characterized in that spherical bodies made of bronze are provided for the porous layers of the core structure for use as a cathode.

8. Electrode according to claim 1, characterized in that the porous core structure composed of spherical bodies is coated externally, at least on top of the fine layer forming the active layer, with a galvanically applied carrier layer made of platinum metals.

9. Electrode according to claim 8, characterized in that a β-lead dioxide layer is applied galvanically to the carrier layer.

10. Electrode according to claim 1, characterized in that the porous core structure is connected at a back side of the coarse layer with a carrier layer.

11. Electrode according to claim 1, characterized in that the porous core structure has a thickness in the range from 1.0 to 1.7 mm.

12. Electrode according to claim 1, characterized in that the fine layer that forms the active layer is homogeneous in structure.

13. Electrode according to claim 1, characterized in that the spherical bodies with grain size range that are used for the layer designed as the coarse layer of the porous core structure comprise a grain size range from 150 to 600 $\mu$m.

14. Electrode according to claim 1, wherein said at least two porous layers are porous layers in which capillary formation is suppressed.

15. A multilayer electrode for an electrolysis cell, said multilayer electrode comprising a porous core structure produced by sintering, composed of an electrically conductive material, wherein said porous core structure contains at least two porous layers, of which one of said at least two porous layers facing the electrolyte forms an active layer and is formed as a fine layer and the other of said at least two porous layers which covers a back of the active layer is in the form of a coarse layer made of particles that are larger than the particles in the active layer, wherein the at least two porous layers contain spherical bodies made of metal being packed densely together and bonded by sintering together, and wherein said active layer is formed of spherical bodies of the same or approximately the same size, having an average diameter of 100 to 250 $\mu$m, and said wherein said coarse layer is formed of spherical bodies having a sphere size that is the same or approximately the same, and having an average diameter of 200 to 800 $\mu$m, wherein spherical bodies made of bronze are provided for the porous layer of the core structure for use as a cathode.

* * * * *